US006824572B2

(12) United States Patent
Murphy

(10) Patent No.: US 6,824,572 B2
(45) **Date of Patent: *Nov. 30, 2004**

(54) VEGETABLE OIL BASED WAX COMPOSITIONS

(75) Inventor: Timothy A. Murphy, Derby, KS (US)

(73) Assignee: Cargill, Incorporated, Wayzata, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/092,341

(22) Filed: Mar. 5, 2002

(65) Prior Publication Data

US 2003/0017431 A1 Jan. 23, 2003

Related U.S. Application Data

(60) Provisional application No. 60/273,647, filed on Mar. 6, 2001.

(51) Int. Cl.[7] ..... C11C 5/00

(52) U.S. Cl. ..... 44/275; 431/288

(58) Field of Search ..... 44/275; 431/288

(56) References Cited

U.S. PATENT DOCUMENTS

| | | | | |
|---|---|---|---|---|
| 1,935,946 | A | | 11/1933 | Egan et al. |
| 1,954,659 | A | | 4/1934 | Will |
| 3,630,697 | A | | 12/1971 | Duling et al. |
| 3,645,705 | A | | 2/1972 | Miller et al. |
| 3,744,956 | A | | 7/1973 | Hess |
| 3,844,706 | A | | 10/1974 | Tsaras |
| 4,118,203 | A | | 10/1978 | Beardmore et al. |
| 4,134,718 | A | | 1/1979 | Kayfetz et al. |
| 4,293,345 | A | | 10/1981 | Zeilstra et al. |
| 4,314,915 | A | | 2/1982 | Wiegers et al. |
| 4,390,590 | A | | 6/1983 | Saunders et al. |
| 4,411,829 | A | | 10/1983 | Schulte-Elte et al. |
| 4,434,306 | A | | 2/1984 | Kobayashi et al. |
| 4,507,077 | A | | 3/1985 | Sapper |
| 4,567,548 | A | | 1/1986 | Schneeberger |
| 4,608,011 | A | | 8/1986 | Comstock |
| 4,614,625 | A | | 9/1986 | Wilson |
| 4,714,496 | A | | 12/1987 | Luken, Jr. et al. |
| 4,759,709 | A | | 7/1988 | Luken, Jr. et al. |
| 4,813,975 | A | | 3/1989 | Poulina et al. |
| 4,842,648 | A | | 6/1989 | Phadoemchit et al. |
| 4,855,098 | A | | 8/1989 | Taylor |
| 5,171,329 | A | | 12/1992 | Lin |
| 5,338,187 | A | | 8/1994 | Elharar |
| 5,578,089 | A | | 11/1996 | Elsamaloty |
| 5,753,015 | A | | 5/1998 | Sinwald et al. |
| 5,843,194 | A | | 12/1998 | Spaulding |
| 5,885,600 | A | | 3/1999 | Blum et al. |
| 6,007,286 | A | | 12/1999 | Toyota et al. |
| 6,019,804 | A | | 2/2000 | Requejo et al. |
| 6,022,402 | A | | 2/2000 | Stephenson et al. |
| 6,063,144 | A | | 5/2000 | Calzada et al. |
| 6,099,877 | A | | 8/2000 | Schuppan |
| 6,106,597 | A | | 8/2000 | Starks et al. |
| 6,132,742 | A | | 10/2000 | Le Bras et al. |
| 6,156,369 | A | | 12/2000 | Eger et al. |
| 6,214,918 | B1 | | 4/2001 | Johnson et al. |
| 6,258,965 | B1 | | 7/2001 | O'Lenick, Jr. |
| 6,276,925 | B1 | | 8/2001 | Varga |
| 6,277,310 | B1 | | 8/2001 | Sleeter |
| 6,284,007 | B1 | | 9/2001 | Tao |
| 6,497,735 | B2 | * | 12/2002 | Tao |
| 6,503,285 | B1 | * | 1/2003 | Murphy |
| 6,582,728 | B1 | | 6/2003 | Platz et al. |
| 6,599,334 | B1 | | 7/2003 | Anderson |
| 6,645,261 | B2 | | 11/2003 | Murphy et al. |
| 2001/0013195 | A1 | | 8/2001 | Tao |
| 2002/0005007 | A1 | | 1/2002 | Roeske et al. |
| 2002/0144455 | A1 | * | 10/2002 | Bertran et al. |
| 2003/0008257 | A1 | * | 1/2003 | Tao |
| 2003/0022121 | A1 | | 1/2003 | Biggs |
| 2003/0046860 | A1 | * | 3/2003 | Tiffany et al. |
| 2003/0061760 | A1 | | 4/2003 | Tao et al. |

FOREIGN PATENT DOCUMENTS

| | | | |
|---|---|---|---|
| EP | 0 685 554 | A1 | 12/1995 |
| JP | 4059897 | A | 2/1992 |
| JP | 6009987 | A | 1/1994 |
| WO | WO 96/14373 | | 5/1996 |

OTHER PUBLICATIONS

Behren et al., "Beeswax and other Non–Paraffin Waxes," Presented at NCA Technical Meeting, Jun. 19–20, 1991, 6 pages.

Bell et al., "Sperm Oil Replacements: Synthetic Wax Esters from Selectively Hydrogenated Soybean and Linseed Oils," *Journal of the American Oil Chemists' Society*, Jun. 1977, pp. 259–263, vol. 54.

Pages from Bitter Creek Candle Supply, Inc., Website (http://www.execpc.com.~bcsupply; now @ http://www.candlesupply.com), available at least by Jun. 29, 2000, 9 pages.

Pages from Ecowax, Nature's Gifts, Inc., Website (http://ngiwax.com/ecowax.htm), available at least by Jul. 5, 2000, 3 pages.

Pages from Heartland Candleworks Website, available @ www.candleworks.org, available at least by Feb. 11, 2000, 4 pages.

Frahm, "Harvest Lights: The only soy–based candle, a bright idea," available @ http://www.extension.uiuc.edu/~stratsoy/new/news/html/909166253,html, Oct. 23, 1998, 2 pages.

*In Business*, "America's Shining Example of Sustainable Business," available @ http://www.candleworks.org, Mar./Apr. 1998, 3 pages.

(List continued on next page.)

*Primary Examiner*—Cephia D. Toomer
(74) *Attorney, Agent, or Firm*—Foley & Lardner LLP

(57) ABSTRACT

Candles formed from vegetable oil-based wax are provided. The wax includes a triacylglycerol component and a fatty acid component, preferably about 50 to 65 wt. % of the triacylglycerol component and about 35 to 50 wt. % of the fatty acid component. The fatty acid component commonly includes at least about 90 wt. % palmitic acid, stearic acid or a mixture thereof. The triacylglycerol component may have a melting point of about 57° C. to about 63° C. and/or an Iodine Value of about 35 to about 45. Methods of producing the candles from the vegetable oil-based wax are also provided.

26 Claims, No Drawings

OTHER PUBLICATIONS

Noller, Chemistry of Organic Compounds, W.B. Saunders Company, 1957, pp. 181 and 192.

Orso, "New Use for Soybeans Has Bright Future," available @ http://www.unitedsoybean.com/news/nr981014.htm, Oct. 14, 1998, 2 pages.

Purdue Agriculture News, Purdue May Agriculture & Natural Resources Package, available @ http://purduenews.uns.purdue.edu/UNS/paks/agpak.digest.9605.html, May 1996, 3 pages.

Purdue News, "Purdue students put the 'happy' back into birthday candles," available @ http://www.purdue.edu/UNS/html4ever/9611.Schweitzer.candles.html, Nov. 1996, 3 pages.

Purdue News, "Purdue students put the 'happy' back into birthday candles," available @ http:/www.purdue.edu/UNS/html4ever/9604.schweitzer.html, May 1996, 2 pages.

Purdue University School of Agriculture, 1998 Farm Progress Show, available @ http://www.admin.ces.purdue.edu/anr/98fps/fpspix/930.html, 1998, 4 pages.

Tao, "Development of Vegetable Lipid–Based Candles," available at http://abe.www.ecn.purdue.edu/ABE/Research/research94/REPORT.94.Book_68.html, 1994, 2 pages.

* cited by examiner

VEGETABLE OIL BASED WAX COMPOSITIONS

CROSS REFERENCE TO OTHER APPLICATIONS

This application claims priority of U.S. Provisional Application Ser. No. 60/273,647, filed on Mar. 6, 2001, the disclosure of which is herein incorporated by reference.

BACKGROUND

Candles have been known and used for illumination since early civilization. A typical candle is formed of a solid or semi-solid body of combustible waxy material and contains a combustible fibrous wick embedded within the waxy material. When the wick of a candle is lit, the generated heat melts the solid wax, and the resulting liquid flows up the wick by capillary action and is combusted. At present, although many advanced illuminating devices are available, candles are still popularly used for decoration or on a special situation as a holiday.

For a long time, beeswax was has been in common usage as a natural wax for candles. Over one hundred years ago, paraffin came into existence, in parallel with the development of the petroleum refining industry. Paraffin is produced from the residue leftover from refining gasoline and motor oils. Paraffin was introduced as a bountiful and low cost alternative to beeswax, which had become more and more costly and in more and more scarce supply. Beeswax presently costs about ten times the cost of paraffin wax.

Today, paraffin is the primary industrial wax used to produce candles. Conventional candles produced from a paraffin wax material typically emit a smoke and can produce a bad smell when burning. In addition, a small amount of particles ("particulates") can be produced when the candle burns. These particles may affect the health of a human when breathed in.

Accordingly, it would be advantageous to have other materials which can be used to form clean burning base materials for forming candles. If possible, such materials would preferably be biodegradable and be derived from renewable raw materials. The candle base materials should preferably have physical characteristics, e.g., in terms of melting point, hardness and/or malleability, that permit the material to be readily formed into candles having a pleasing appearance and/or feel to the touch, as well as having desirable olfactory properties.

In the past, attempts to formulate candle waxes from vegetable oil-based materials have often suffered from a variety of problems. For example, relative to paraffin-based candles, vegetable oil-based candles have been reported to exhibit one or more disadvantages such as cracking, air pocket formation, product shrinkage and a natural product odor associated with soybean materials. Various soybean-based waxes have also been reported to suffer performance problems relating to optimum flame size, effective wax and wick performance matching for an even burn, maximum burning time, product color integration and/or product shelf life. In order to achieve the aesthetic and functional product surface and quality sought by consumers of candles, it would be advantageous to develop new vegetable oil-based waxes that overcome as many of these deficiencies as possible.

SUMMARY

The present invention relates to candles having low paraffin content and methods of producing such candles. The candles are typically formed from vegetable oil-based material, a biodegradable material produced from renewable resources. Since the candles are formed from a material with a low paraffin content and preferably are substantially devoid of paraffin, the candles are generally clean burning, emitting very little soot. The combination of low soot emission, biodegradability and production from renewable raw material makes the present candle a particularly environmentally friendly product.

The present wax is particularly good for use in forming pillar, votive and taper candles. The wax is desirably formulated to inhibit surface adhesion to facilitate pillar and votive mold release. Good mold release is an important economic consideration in the manufacture of candles, allowing a more rapid turnaround time on production. In addition, it is desirable that the wax is capable of being blended with natural color additives to provide an even solid color distribution.

In applications which require a harder material, such as pillar or taper candles, fatty acid substances (e.g., palmitic and/or stearic acid) can be blended with an hydrogenated oil. In general, the higher the ratio of the hydrogenated oil to the fatty acid, the softer the product. A higher percentage of fatty acid generally produces a harder product. However, too high a level of a fatty acid, such as palmitic acid, can lead to cracking or breaking.

The vegetable oil-based materials which may be used to form the present candles are typically solid, firm but not brittle, generally somewhat malleable, with no free oil visible. Such materials commonly are predominantly made up of a mixture of a triacylglycerol component and a fatty acid component. The fatty acid component is often derived from saponification of a vegetable-oil based material and commonly includes a mixture of two or more fatty acids. For example, the fatty acid component may suitably include palmitic acid and/or stearic acid, e.g., where at least about 90 wt. % of the fatty acid which makes up the fatty acid component is palmitic acid, stearic acid or a mixture thereof.

The triacylglycerol component may suitably be chosen to have a melting point of about 57° C. to 63° C. (135° F. to 145° F.). One embodiment of such a triacylglycerol stock can be formed by blending fully hydrogenated and partially hydrogenated vegetable oils to produce a blend with an Iodine Value of about 35–45 and the desired melting point. For example, a triacylglycerol stock can be formed by blending appropriate amounts of fully hydrogenated soybean and palm oils with a partially hydrogenated soybean oil having an Iodine Value of about 60 to 75. As used herein, a fully hydrogenated vegetable oil refers to a vegetable oil which has been hydrogenated to an Iodine Value of no more than about 5. Instead of employing a highly hydrogenated vegetable oil, triacylglycerol material derived from precipitating a hard fat fraction from a vegetable oil may be employed. Hard fat fractions obtained in this manner are predominantly composed of saturated triacylglycerols.

Candles may be made from pure vegetable oil-based wax or may include minor amounts of other additives to modify the properties of the waxy material. Examples of types of additives which may commonly be incorporated into the present candles include colorants, fragrances (e.g., fragrance oils), insect repellants, and the like.

If the present wax is used to produce a candle, the same standard wicks that are employed with other waxes (e.g., paraffin and/or beeswax) can be utilized. In order to fully benefit from the environmentally-safe aspect of the present wax, it is desirable to use a wick which does not have a metal core, such as a lead or zinc core. One example of a suitable wick material is a braided cotton wick.

DETAILED DESCRIPTION

The physical properties of a triacylglycerol are primarily determined by (i) the chain length of the fatty acyl chains, (ii) the amount and type (cis or trans) of unsaturation present in the fatty acyl chains, and (iii) the distribution of the different fatty acyl chains among the triacylglycerols that make up the fat or oil. Those fats with a high proportion of saturated fatty acids are typically solids at room temperature while triacylglycerols in which unsaturated fatty acyl chains predominate tend to be liquid. Thus, hydrogenation of a triacylglycerol stock ("TAGS") tends to reduce the degree of unsaturation and increase the solid fat content and can be used to convert a liquid oil into a semisolid or solid fat. Hydrogenation, if incomplete, also tends to result in the isomerization of some of the double bonds in the fatty acyl chains from a cis to a trans configuration. By altering the distribution of fatty acyl chains in the triacylglycerol moieties of a fat or oil, e.g., by blending together materials with different fatty acid profiles, changes in the melting, crystallization and fluidity characteristics of a triacylglycerol stock can be achieved.

Herein, when reference is made to the term "triacylglycerol-based material" the intent is to refer to a material made up predominantly of triacylglycerols, typically including at least about 75 wt. % and, preferably about 90 wt. % or more triacylglycerol stock.

As employed herein, the terms "triacylglycerol stock" and "triacylglycerol component" are used interchangeably to refer to materials that are made up entirely of one or more triacylglycerol compounds. Commonly, the triacylglycerol stock or triacylglycerol component is a complex mixture triacylglycerol compounds, which very often are derivatives of C16 and/or C18 fatty acids. The triacylglycerol stock, whether altered or not, are generally derived from various plant and animal sources, such as oil seed sources. The terms at least include within their scope: (a) such materials which have not been altered after isolation; (b) materials which have been refined, bleached and/or deodorized after isolation; (c) materials obtained by a process which includes fractionation of a triacylglycerol oil; and, also, (d) oils obtained from plant or animal sources and altered in some manner, for example through partial hydrogenation. Herein, the terms "triacylglycerols" and "triglycerides" are intended to be interchangeable. It will be understood that a triacylglycerol stock may include a mixture of triacylglycerols, and a mixture of triacylglycerol isomers. By the term "triacylglycerol isomers," reference is meant to triacylglycerols which, although including the same esterified carboxylic acid residues, may vary with respect to the location of the residues in the triacylglycerol. For example, a triacylglycerol oil such as a vegetable oil stock can include both symmetrical and unsymmetrical isomers of a triacylglycerol molecule which includes two different fatty acyl chains (e.g., includes both stearate and oleate groups).

As indicated above, any given triacylglycerol molecule includes glycerol esterified with three carboxylic acid molecules. Thus, each triacylglycerol includes three fatty acid residues. In general, oils extracted from any given plant or animal source comprise a mixture of triacylglycerols, characteristic of the specific source. The mixture of fatty acids isolated from complete hydrolysis of the triacylglycerols in a specific source is referred to herein as a "fatty acid profile." By the term "fatty acid profile" reference is made to the identifiable fatty acid residues in the various triacylglycerols. The distribution of specific identifiable fatty acids is characterized herein by the amounts of the individual fatty acids as a weight percent of the total mixture of fatty acids obtained from hydrolysis of the particular oil stock. The distribution of fatty acids in a particular oil or fat may be readily determined by methods known to those skilled in the art, such as by gas chromatography.

Palmitic acid ("16:0") and stearic acid ("18:0") are saturated fatty acids and triacylglycerol acyl chains formed by the esterification of either of these acids do not contain any carbon-carbon double bonds. The nomenclature in the above abbreviations refers to the number of total carbon atoms in fatty acid followed by the number of carbon-carbon double bonds in the chain. Many fatty acids such as oleic acid, linoleic acid and linolenic acid are unsaturated, i.e., contain one or more carbon-carbon double bonds. Oleic acid is an 18 carbon fatty acid with a single double bond (i.e., an 18:1 fatty acid), linoleic acid is an 18 carbon fatty acid with two double bonds or points of unsaturation (i.e., an 18:2 fatty acid), and linolenic is an 18 carbon fatty acid with three double bonds (i.e., an 18:3 fatty acid).

The fatty acid profile of the triacylglycerol stock which makes up the significant portion of the present vegetable oil-based wax is generally consists predominantly of fatty acids having 16 and 18 carbon atoms. The amount of shorter chain fatty acids, i.e., fatty acids having 14 carbon atoms or less in the fatty acid profile of the triacylglycerols is generally very low, e.g., no more than about 1.0 wt. %. The triacylglycerol stock generally includes a moderate amount of saturated 16 carbon fatty acid, e.g., at least about 14 wt. % and typically no more than about 25 wt. %. Very often suitable triacylglycerol stocks include about 15 wt. % to about 20 wt. % saturated 16 carbon fatty acid.

As mentioned above, the fatty acid profile of the triacylglycerols commonly includes a significant amount of C18 fatty acids. In order to achieve a desirable melting/hardness profile, the fatty acids typically include a mixture of saturated (18:0—stearic acid) and monounsaturated fatty acids (18:1). The unsaturated fatty acids are predominantly monounsaturated fatty acids (18:1), such as oleic acid. Desirably, the triacylglycerols have a fatty acid profile which includes about 14 to 25 wt. % 16:0 fatty acid; about 35 to 45 wt. % 18:0 fatty acid; and about 35 to 45 wt. % 18:1 fatty acid.

The triacylglycerols' fatty acid profile is typically selected to provide a triacylglycerol-based material with a melting point of about 57 to 63° C. This can be done by altering several different parameters. As indicated above, the primary factors which influence the solid fat and melting point characteristics of a triacylglycerol are the chain length of the fatty acyl chains, the amount and type of unsaturation present in the fatty acyl chains, and the distribution of the different fatty acyl chains within individual triacylglycerol molecules. The present triacylglycerol-based materials are formed from triacylglycerols with fatty acid profiles dominated by C18 fatty acids (fatty acids with 18 carbon atoms). Triacylglycerols with extremely large amounts of saturated 18 carbon fatty acid (also referred to as 18:0 fatty acid or stearic acid) tend to have melting points which would likely be too high for the producing the present candles since such materials may be prone to brittleness and cracking. The melting point of such triacylglycerols can be lowered by increasing the amount of shorter chain fatty acids and/or unsaturated fatty acids in their fatty acid profiles. Since the present triacylglycerol-based materials have fatty acid profiles in which C18 fatty acids predominate, the desired the melting point and/or solid fat index is typically achieved by altering the amount of unsaturated C18 fatty acids present (predominantly 18:1 fatty acid(s)). The triacylglycerol stocks employed in the present vegetable oil-based waxes are desirably selected to have a melting point of about 57 to 63° C. (circa 135–145° F.).

The method(s) described herein can be used to provide candles from triacylglycerol-based materials having a melting point and/or solid fat content which imparts desirable molding and/or burning characteristics. The solid fat content as determined at one or more temperatures can be used as a measure of the fluidity properties of a triacylglycerol stock. The melting characteristics of the triacylglycerol-based material may be controlled based on its solid fat index. The solid fat index is a measurement of the solid content of a triacylglycerol material as a function of temperature, generally determined at number of temperatures over a range from 10° C. (50° F.) to 40° C. (104° F.). Solid fat content ("SFC") can be determined by Differential Scanning Calorimetry ("DSC") using the methods well known to those skilled in the art. Fats with lower solid fat contents have a lower viscosity, i.e., are more fluid, than their counterparts with high solid fat contents.

The melting characteristics of the triacylglycerol-based material may be controlled based on its solid fat index to provide a material with desirable properties for forming a candle. Although the solid fat index is generally determined by measurement of the solid content of a triacylglycerol material as a function over a range of 5 to 6 temperatures, for simplicity triacylglycerol-based materials are often characterized in terms of their solid fat contents at 10° C. ("SFI-10") and/or 40° C. ("SFI-40").

One measure for characterizing the average number of double bonds present in a triacylglycerol stock which includes triacylglycerol molecules with unsaturated fatty acid residues is its Iodine Value. The Iodine Value of a triacylglycerol or mixture of triacylglycerols is determined by the Wijs method (A.O.C.S. Cd1–25). For example, soybean oil typically has an Iodine Value of about 125 to about 135 and a pour point of about 0° C. to about −10° C. Hydrogenation of soybean oil to reduce its Iodine Value to about 90 or less increases the melting point of the material as evidenced by the increased in its pour point to about 10 to 20° C. Further hydrogenation can produce a material which is a solid at room temperature and may have a melting point of 65° C. or even higher. Typically, the present candles are formed from vegetable oil-based waxes which include a triacylglycerol stock having an Iodine Value of about 35 to about 45, and more desirably about 35 to about 40.

Feedstocks used to produce the triacylglycerol component in the present candle stock material have generally been neutralized and bleached. The triacylglycerol stock may have been processed in other ways prior to use, e.g., via fractionation, hydrogenation, refining, and/or deodorizing. Preferably, the feedstock is a refined, bleached triacylglycerol stock. The processed feedstock material may be blended with one or more other triacylglycerol feedstocks to produce a material having a desired distribution of fatty acids, in terms of carbon chain length and degree of unsaturation. Typically, the triacylglycerol feedstock material is hydrogenated to reduce the overall degree of unsaturation in the material and provide a triacylglycerol material having physical properties which are desirable for a candle-making base material.

Suitable hydrogenated vegetable oils for use in the present triacylglycerol-based material includes hydrogenated soybean oil, hydrogenated cottonseed oil, hydrogenated sunflower oil, hydrogenated canola oil, hydrogenated corn oil, hydrogenated olive oil, hydrogenated peanut oil, hydrogenated safflower oil or mixtures thereof. The vegetable oil may be hydrogenated to obtain a desired set of physical characteristics, e.g., in terms of melting point, solid fat content and/or Iodine value. The hydrogenation is typically carried out at elevated temperature, such as 400° F. to 450° F. (about 205° C. to about 230° C.), and relatively low hydrogen pressure (e.g., no more than about 25 psi) in the presence of a hydrogenation catalyst. One example of a suitable hydrogenation catalyst, is a nickel catalyst, such as a powdered nickel catalyst provided as a 20–30 wt. % in a solid vegetable oil.

The following discussion of the preparation of a vegetable oil derived candle stock material is described as a way of exemplifying a method for producing the present triacylglycerol-based material. A partially hydrogenated refined, bleached vegetable oil, such as an RB soybean oil which has been hydrogenated to an IV of about 60–75, may be blended with a second oil seed derived material having a higher melting point, e.g., a fully hydrogenated soybean or palm oil. The resulting blend may still be too soft for use in making a pillar candle. The vegetable oil blend could, however, be blended with a fatty acid component (e.g., a mixture of palmitic and stearic acids) until the melting point and/or solid fat index of the resulting material had been modified to fall within a desired range. The final candle wax formulation would then include a mixture of a vegetable oil derived triacylglycerol component and a fatty acid component.

Candles can be produced from the triacylglycerol-based material using a number of different methods. In one common process, the vegetable oil-based wax is heated to a molten state. If other additives such as colorants and/or fragrance oils are to be included in the candle formulation, these may be added to the molten wax or mixed with vegetable oil-based wax prior to heating. The molten wax is then solidified around a wick. For example, the molten wax can be poured into a mold which includes a wick disposed therein. The molten wax is then cooled to solidify the wax in the shape of the mold. Depending on the type of candle being produced, the candle may be unmolded or used as a candle while still in the mold. Examples of such unmolded candles include pillar candles and taper candles. Where the candle is designed to be used in unmolded form, it may also be coated with an outer layer of higher melting point material.

Alternatively, the triacylglycerol-based material can be formed into a desired shape, e.g., by pouring molten vegetable oil-based wax into a mold and removing the shaped material from the mold after it has solidified. A wick may then be inserted into the shaped waxy material using techniques known to those skilled in the art, e.g., using a wicking machine such as a Kurschner wicking machine.

The candle wax may be fashioned into a variety of forms, commonly ranging in size from powdered or ground wax particles approximately one-tenth of a millimeter in length or diameter to chips, flakes or other pieces of wax approximately two centimeters in length or diameter. Where designed for use in compression molding of candles, the waxy particles are generally spherical, prilled granules having an average mean diameter no greater than one (1) millimeter.

Prilled waxy particles may be formed conventionally, by first melting a triacylglycerol-based material, in a vat or similar vessel and then spraying the molten waxy material through a nozzle into a cooling chamber. The finely dispersed liquid solidifies as it falls through the relatively cooler air in the chamber and forms the prilled granules that, to the naked eye, appear to be spheroids about the size of grains of sand. Once formed, the prilled triacylglycerol-based material can be deposited in a container and, optionally, combined with the coloring agent and/or scenting agent.

The candle wax may be packaged as part of a candle-making kit which includes also typically would include instruction with the candle beads. The candle-making kit typically also includes material which can be used to form a wick.

A wide variety of coloring and scenting agents, well known in the art of candle making, are available for use with waxy materials. Typically, one or more dyes or pigments is employed provide the desired hue to the color agent, and one or more perfumes, fragrances, essences or other aromatic oils is used provide the desired odor to the scenting agent. The coloring and scenting agents generally also include liquid carriers which vary depending upon the type of color- or scent-imparting ingredient employed. The use of liquid organic carriers with coloring and scenting agents is preferred because such carriers are compatible with petroleum-based waxes and related organic materials. As a result, such coloring and scenting agents tend to be readily absorbed into waxy materials. It is especially advantageous if a coloring and/or scenting agent is introduced into the waxy material when it is in the form of prilled granules.

The colorant is an optional ingredient and is commonly made up of one or more pigments and dyes. Colorants are typically added in a quantity of about 0.001–2 wt. % of the waxy base composition. If a pigment is employed, it is typically an organic toner in the form of a fine powder suspended in a liquid medium, such as a mineral oil. It may be advantageous to use a pigment that is in the form of fine particles suspended in a vegetable oil, e.g., an natural oil derived from an oilseed source such as soybean or corn oil. The pigment is typically a finely ground, organic toner so that the wick of a candle formed eventually from pigment-covered wax particles does not clog as the wax is burned. Pigments, even in finely ground toner forms, are generally in colloidal suspension in a carrier.

If a dye constituent is utilized, it may be dissolved in an organic solvent. A variety of pigments and dyes suitable for candle making are listed in U.S. Pat. No. 4,614,625, the disclosure of which is herein incorporated by reference. The preferred carriers for use with organic dyes are organic solvents, such as relatively low molecular weight, aromatic hydrocarbon solvents; e.g. toluene and xylene. The dyes ordinarily form true solutions with their carriers. Since dyes tend to ionize in solution, they are more readily absorbed into the prilled wax granules, whereas pigment-based coloring agents tend to remain closer to the surface of the wax.

Candles often are designed to appeal to the olfactory as well as the visual sense. This type of candle usually incorporates a fragrance oil in the waxy body material. As the waxy material is melted in a lighted candle, there is a release of the fragrance oil from the liquefied wax pool. The scenting agent may be an air freshener, an insect repellent or more serve more than one of such functions.

The air freshener ingredient commonly is a liquid fragrance comprising one or more volatile organic compounds which are available from perfumery suppliers such IFF, Firmenich Inc., Takasago Inc., Belmay, Noville Inc., Quest Co., and Givaudan-Roure Corp. Most conventional fragrance materials are volatile essential oils. The fragrance can be a synthetically formed material, or a naturally derived oil such as oil of Bergamot, Bitter Orange, Lemon, Mandarin, Caraway, Cedar Leaf, Clove Leaf, Cedar Wood, Geranium, Lavender, Orange, Origanum, Petitgrain, White Cedar, Patchouli, Lavandin, Neroli, Rose and the like.

A wide variety of chemicals are known for perfumery such as aldehydes, ketones, esters, alcohols, terpenes, and the like. A fragrance can be relatively simple in composition, or can be a complex mixture of natural and synthetic chemical components. A typical scented oil can comprise woody/earthy bases containing exotic constituents such as sandalwood oil, civet, patchouli oil, and the like. A scented oil can have a light floral fragrance, such as rose extract or violet extract. Scented oil also can be formulated to provide desirable fruity odors, such as lime, lemon or orange.

Synthetic types of fragrance compositions either alone or in combination with natural oils such as described in U.S. Pat. Nos. 4,314,915; 4,411,829; and 4,434,306; incorporated herein by reference. Other artificial liquid fragrances include geraniol, geranyl acetate, eugenol, isoeugenol, linalool, linalyl acetate, phenethyl alcohol, methyl ethyl ketone, methylionone, isobornyl acetate, and the like. The scenting agent can also be a liquid formulation containing an insect repellent such as citronellal, or a therapeutic agent such as eucalyptus or menthol. Once the coloring and scenting agents have been formulated, the desired quantities are combined with waxy material which will be used to form the body of the candle. For example, the coloring and/or scenting agents can be added to the waxy materials in the form of prilled wax granules. When both coloring and scenting agents are employed, it is generally preferable to combine the agents together and then add the resulting mixture to the wax. It is also possible, however, to add the agents separately to the waxy material. Having added the agent or agents to the wax, the granules are coated by agitating the wax particles and the coloring and/or scenting agents together. The agitating step commonly consists of tumbling and/or rubbing the particles and agent(s) together. Preferably, the agent or agents are distributed substantially uniformly among the particles of wax, although it is entirely possible, if desired, to have a more random pattern of distribution. The coating step may be accomplished by hand, or with the aid of mechanical tumblers and agitators when relatively large quantities of prilled wax are being colored and/or scented.

Illustrative Embodiments

A number of illustrative embodiments of the present candle wax and candles produced therefrom are described below. The embodiments described are intended to provide illustrative examples of the present wax and candles and are not intended to limit the scope of the invention.

One embodiment is directed to a candle wax which includes about 50 to 65 wt. % of a triacylglycerol component and about 35 to 50 wt. % (more desirably about 35 to 45 wt. %) of a fatty acid component. The fatty acid component commonly includes at least about 90 wt. % palmitic acid and/or stearic acid. The triacylglycerol component can have an Iodine Value of about 35 to about 45 and typically has a fatty acid composition which includes about 14 to 25 wt. % 16:0 fatty acid; about 35 to 45 wt. % 18:0 fatty acid; and about 35 to 45 wt. % 18:1 fatty acid.

Another embodiment is directed to a candle wax which includes about 50 to 65 wt. % of a triacylglycerol component and about 35 to 50 wt. % of a fatty acid component. The fatty acid component includes at least about 90 wt. % palmitic acid, stearic acid or a mixture thereof. The triacylglycerol component has a melting point of about 57–63° C. (135 to 145° F.); and a fatty acid composition which includes about 14 to 25 wt. % 16:0 fatty acid; about 35 to 45 wt. % 18:0 fatty acid; and about 35 to 45 wt. % 18:1 fatty acid. The triacylglycerol component typically includes hydrogenated vegetable oil. For example, the wax can include hydrogenated soybean oil, hydrogenated cottonseed oil, hydrogenated sunflower oil, hydrogenated canola oil, hydrogenated corn oil, hydrogenated palm oil, hydrogenated olive oil, hydrogenated peanut oil, hydrogenated safflower oil or a mixture thereof. Typically, the hydrogenated vegetable oil includes hydrogenated bleached, refined vegetable oil. The triacylglycerol component commonly has an Iodine Value of about 35 to about 45. The melting point of the vegetable oil-based wax is desirably about 57 to 63° C.

Candles formed from the present vegetable oil-based candle include a wick and the vegetable oil-based wax. In one embodiment, the vegetable oil-based wax includes a fatty acid component including at least about 90 wt. % palmitic acid, stearic acid or a mixture thereof; and the triacylglycerol component has a melting point of about 57 to 63° C. and fatty acid composition which includes about 14 to 25 wt. % 16:0 fatty acid; about 35 to 45 wt. % 18:0 fatty acid; and about 35 to 45 wt. % 18:1 fatty acid. The candle wax can include other additives. For instance, the wax may often include colorant. Another additive which is commonly added to candle wax formulations is fragrance oil, typically present as about 3–5 wt. % of the vegetable oil-based wax. For some applications, it may be advantageous to include insect repellant (e.g., citronella or neem oil) in the wax formulation The wax used to form the present candles desirably includes about 50 to 65 wt. % of the triacylglycerol component and includes about 35 to 50 wt. % of the fatty acid component. Particularly suitable waxes include a triacylglycerol component which has an Iodine Value of about 35 to about 45. The fatty acid component desirably includes about 35 to 50 wt. % palmitic acid and about 45 to 65 wt. % stearic acid and, more desirably, includes about 40 to 45 wt. % palmitic acid and about 50 to 60 wt. % stearic acid. It is often desirable to employ a vegetable oil-based wax with a melting point of about 57 to 63° C. to form the present candles.

A particularly suitable embodiment is directed to a candle wax which includes about 50 to 65 wt. % of a triacylglycerol component and about 35 to 50 wt. % of a fatty acid component. In this embodiment, the fatty acid component includes about 35 to 55 wt. % palmitic acid and about 45 to 65 wt. % stearic acid; and the triacylglycerol component has a melting point of about 57–63° C. and an Iodine Value of about 35 to about 45 includes about 14 to 25 wt. % 16:0 fatty acid; about 35 to 45 wt. % 18:0 fatty acid; and about 35 to 45 wt. % 18:1 fatty acid. In this embodiment, it is particularly desirable to use a wax which has a melting point of about 57 to 63° C.

Another embodiment is directed to a candle which includes a wick and a vegetable oil-based wax. The vegetable oil-based wax desirably includes a fatty acid component including about 35 to 55 wt. % palmitic acid and about 45 to 65 wt. % stearic acid; and a triacylglycerol component having a melting point of about 57–63° C.; an Iodine Value of about 35 to about 45; and has a fatty acid composition which includes about 14 to 25 wt. % 16:0 fatty acid; about 35 to 45 wt. % 18:0 fatty acid; and about 35 to 45 wt. % 18:1 fatty acid. The candle is desirably formed from a vegetable oil-based wax which has a melting point of about 57 to 63° C.

A method of producing a candle is provided by another embodiment. The method includes heating a vegetable oil-based wax to a molten state; and solidifying the molten vegetable oil-based wax around a portion of a wick. A related method of producing a candle includes heating a vegetable oil-based wax to a molten state; pouring the molten vegetable oil-based wax into a mold which includes a wick disposed therein; and solidifying the molten vegetable oil-based wax. The vegetable oil-based wax employed in these methods typically includes a fatty acid component including at least about 90 wt. % palmitic acid, stearic acid or a mixture thereof; and a triacylglycerol component having a fatty acid composition which including about 14 to 25 wt. % 16:0 fatty acid; about 35 to 45 wt. % 18:0 fatty acid; and about 35 to 45 wt. % 18:1 fatty acid. The triacylglycerol component desirably has a melting point of about 57–63° C. and/or vegetable oil-based wax commonly has a melting point of about 57 to 63° C and is typically heated to about 5° C. (circa 10° F.) above its melting point to convert it into the molten state.

The following example is presented to illustrate the present invention and to assist one of ordinary skill in making and using the same. The example is not intended in any way to otherwise limit the scope of the invention.

EXAMPLE

A vegetable oil-based wax suitable for use in making candles can be produced according to the following procedure. A blend of partially hydrogenated refined, bleached soybean oil (60 wt. %), fully hydrogenated palm oil (15 wt. %) and fully hydrogenated refined, bleached soybean oil (25 wt. %) is heated to about 170–200° F. (circa 75–95° C). The partially hydrogenated refined, bleached soybean oil can have a melting point of 112–115° F. (circa 44–46° C.) and an Iodine Value of 60–64. The resulting blend would have a melting point of 137–138° F. (circa 58.5° C.) and an Iodine Value of 35–40. Typical fatty acid profiles for the partially hydrogenated refined, bleached soybean oil and the resulting blend are shown in Table 1 below. The fatty acid profile of a typical refined, bleached soybean oil ("RB-SBO") is also shown for comparison.

TABLE 1

Fatty Acid Profiles (Wt. %)

| Fatty Acid(s) | RB-SBO | Partially [H] RB-SBO | Blend |
|---|---|---|---|
| ≦C14 | <0.1 | <0.3 | 0.3 |
| 16:0 | 10–11 | 10.4 | 15.5 |
| 18:0 | 4–6 | 18.3 | 40.1 |
| 18:1 | 20–30 | 66.8 | 40.3 |
| 18:2 | 50–60 | 2.9 | 2.6 |
| 18:3 | 5–10 | 0.1 | — |
| Other | <1 | 1.0 | — |

In order to produce a candle wax composition suitable for forming pillar candles, the triacylglycerol blend (60 wt. %) can be blended with Hystrene® 4516 fatty acid (40 wt. %). This can be carried out by adding the fatty acid component to a molten form of the triacylglycerol blend at about 170–180° F. (circa 75–80° C.). Hystrene® 4516 fatty acid is a commercially available mixture of C14 to C18 saturated fatty acids sold by the Humko Chemical Division of Witco Corporation (Memphis Tenn.). "Natural palmitic acid", which is produced from the saponification product of hydrogenated palm oil, has a similar composition and is also quite suitable for use in forming the present candle wax compositions. The composition of Hystrene® 4516 fatty acid and natural palmitic acid are shown in Table 2 below. If other additives such as colorants and/or fragrance oils are to be included in the candle formulation, these may be added to the molten triacylglycerol/fatty acid blend or mixed with the molten triacylglycerol blend prior to the addition of the fatty acid component.

TABLE 2

| Fatty Acid(s) | Hystrene ® 4516 | "Natural Palmitic" |
|---|---|---|
| Myristic Acid (14:0) | 1 wt. % | 2.0 wt. % |
| Palmitic Acid (16:0) | 42 wt. % | 43.0 wt. % |
| Stearic Acid (18:0) | 55 wt. % | 52.8 wt. % |
| Margaric Acid (17:0) | 1.5 wt. % | — |

The final candle formulation may be used to directly produce candles or may be stored in a molten state in a heated tank. Often it may be more convenient to convert the candle wax into particle form. As described above, the molten candle wax may be converted into flakes or prilled granules to facilitate handling and storage in small lots.

The invention has been described with reference to various specific and illustrative embodiments and techniques. However, it should be understood that many variations and modifications may be made while remaining within the spirit and scope of the invention.

What is claimed is:

1. A candle wax which includes about 50 to 65 wt. % of a triacyiglycerol component and about 35 to 50 wt. % of a fatty acid component;

wherein the fatty acid component includes at least about 90 wt. % palmitic acid, stearic acid or a mixture thereof; and the triacylglycerol component has an Iodine Value of about 35 to 45; and a fatty acid composition which includes about 14 to 25 wt. % 16:0 fatty acid; about 35 to 45 wt. % 18:0 fatty acid; and about 35 to 45 wt. % 18:1 fatty acid.

2. The wax of claim 1 wherein said wax has a melting point of about 57 to 63° C.

3. A candle wax which includes about 50 to 65 wt. % of a triacylglycerol component and about 35 to 50 wt. % of a fatty acid component;

wherein the fatty acid component includes at least about 90 wt. % palmitic acid, stearic acid or a mixture thereof; and the triacylglycerol component has a melting point of about 57 to 63° C.; and a fatty acid composition which includes about 14 to 25 wt. % 16:0 fatty acid; about 35 to 45 wt. % 18:0 fatty acid; and about 35 to 45 wt. % 18:1 fatty acid.

4. The wax of claim 3 wherein the triacylglycerol component includes hydrogenated vegetable oil.

5. The wax of claim 4 wherein the hydrogenated vegetable oil includes hydrogenated soybean oil, hydrogenated cottonseed oil, hydrogenated sunflower oil, hydrogenated canola oil, hydrogenated corn oil, hydrogenated palm oil, hydrogenated olive oil, hydrogenated peanut oil, hydrogenated safflower oil or a mixture thereof.

6. The wax of claim 5 wherein hydrogenated vegetable oil includes hydrogenated bleached, refined vegetable oil.

7. The wax of claim 3 wherein the triacyiglycerol component has an Iodine Value of about 35 to about 45.

8. The wax of claim 3 wherein said wax has a melting point of about 57to 63° C.

9. A candle comprising a wick and a vegetable oil-based wax;

wherein the vegetable oil-based wax includes about 35 to 50 wt. % of a fatty acid component including at least about 90 wt. % palmitic acid, tearic acid or a mixture thereof; and a triacylglycerol component having a melting point of about 57 to 63° C. and a fatty acid composition which includes about 14 to 18 wt. % 16:0 fatty acid; about 35 to 45 wt. % 18:0 fatty acid; and about 35 to 45 wt. % 18:1 fatty acid.

10. The candle of claim 9 wherein the wax includes about 50 to 65 wt. % of the triacyiglycerol component.

11. The candle of claim 9 wherein the triacyiglycerol component has an Iodine Value of about 35 to 45.

12. The candle of claim 9 wherein the fatty acid component includes about 35 to 50 wt. % palmitic acid and about 45 to 65 wt. % stearic acid.

13. The candle of claim 9 wherein the wax further comprises colorant.

14. The candle of claim 9 wherein the wax further comprises insect repellant.

15. The candle of claim 9 wherein the wax further comprises fragrance oil.

16. The candle of claim 9 wherein the vegetable oil-based wax has a melting point of about 57 to 63° C.

17. A method of producing a candle comprising:

heating a vegetable oil-based wax to a molten state; and solidifying the molten vegetable oil-based wax around a portion of a wick;

wherein the vegetable oil-based wax includes about 35 to 50 wt. % of a fatty acid component including at least about 90 wt. % palmitic acid, stearic acid or a mixture thereof; and a triacylglycerol component having a melting point of about 57 to 63° C. and a fatty acid composition which includes about 14 to 25 wt. % 16:0 fatty acid; about 35 to 45 wt. % 18:0 fatty acid; and about 35 to 45 wt. % 18:1 fatty acid.

18. The method of claim 17 wherein the triacyiglycerol component has an Iodine Value of about 35 to about 45.

19. The method of claim 17 wherein the fatty acid component includes about 35 to 50 wt. % palmitic acid and about 45 to 65 wt. % stearic acid.

20. A candle comprising a wick and a vegetable oil-based wax;

wherein the vegetable oil-based wax comprises about 35 to 50 wt. % of a fatty acid component, which includes about 35 to 50 wt. % palmitic acid and about 45 to 65 wt. % stearic acid; and a triacylglycerol component having a melting point of about 57 to 63° C. and a fatty acid composition which includes about 14 to 18 wt. % 16:0 fatty acid; about 35 to 45 wt. % 18:0 fatty acid; and about 35 to 45 wt. % 18:1 fatty acid.

21. The candle of claim 20, wherein the vegetable oil-based wax includes about 50 to 65 wt. % of the triacylglycerol component.

22. The candle of claim 20, wherein the vegetable oil-based wax is substantially devoid of paraffin.

23. The wax of claim 1, wherein the wax is substantially devoid of paraffin.

24. The wax of claim 3, wherein the wax is substantially devoid of paraffin.

25. The candle of claim 9, wherein the vegetable oil-based wax is substantially devoid of paraffin.

26. The method of claim 17, wherein the vegetable oil-based wax is substantially devoid of paraffin.

* * * * *